US005749120A

United States Patent [19]

Amoretti

[11] Patent Number: 5,749,120

[45] Date of Patent: May 12, 1998

[54] CONTROL DEVICE, PARTICULARLY FOR STEAM-GENERATING APPLIANCES FOR HOUSEHOLD AND/OR INDUSTRIAL CLEANING

[75] Inventor: Luigi Amoretti, Romano d'Ezzelino, Italy

[73] Assignee: T.P.A. Impex S.p.A., Romano d'Ezzelino, Italy

[21] Appl. No.: 657,244

[22] Filed: Jun. 3, 1996

[30] Foreign Application Priority Data

Jun. 5, 1995 [IT] Italy ..... PD95A0112

[51] Int. Cl.[6] ..... A47L 9/00

[52] U.S. Cl. ..... 15/339; 15/321

[58] Field of Search ..... 15/321, 339

[56] References Cited

U.S. PATENT DOCUMENTS

| | | | |
|---|---|---|---|
| 3,885,267 | 5/1975 | Maurer et al. . | |
| 4,514,874 | 5/1985 | Kurz . | |
| 4,882,978 | 11/1989 | Bruggeman et al. . | |
| 5,224,237 | 7/1993 | Ambrosiano . | |
| 5,400,462 | 3/1995 | Amoretti | 15/321 |
| 5,613,271 | 3/1997 | Thomas | 15/321 |

*Primary Examiner*—Chris K. Moore

*Attorney, Agent, or Firm*—Guido Modiano; Albert Josif

[57] ABSTRACT

The control device for steam-generating appliances has at least one component having a variable internal volume that is accommodated in the handle of a fixture of the steam-generating appliance, and is filled with a nonconducting fluid. The component has a variable internal volume which can be directly or indirectly compressed by a user, and is connected, through an actuation tube, to a pressure transducer. The transducer is accommodated inside the body of the steam-generating appliance, and in turn actuates a respective steam delivery control valve.

11 Claims, 3 Drawing Sheets

CONTROL DEVICE, PARTICULARLY FOR STEAM-GENERATING APPLIANCES FOR HOUSEHOLD AND/OR INDUSTRIAL CLEANING

BACKGROUND OF THE INVENTION

The present invention relates to a control device, particularly but not exclusively useful for steam-generating appliances for household and/or industrial cleaning.

A large number of steam-generating appliances are currently commercially available. These appliances are used for cleaning houses and public places such as for example restaurants, industrial premises, shopping centers, etcetera.

The wide variety of steam-generating appliances can be divided into three constructional types that can be distinguished from each other substantially by the manner in which the delivery of steam to other components adapted to perform various auxiliary functions is controlled.

A first constructional type has an appliance body that accommodates a boiler and is prolonged, for the delivery of the steam, by means of a tube ending at the free end with a handle that is adapted to control the movement of an optionally replaceable fixture or cleaning tool of the steam-generating appliance.

In this first embodiment, switches are accommodated at said handle and, by means of electrical connecting wires arranged inside the tube, connect to an electric valve which in turn controls the flow of steam or other auxiliary functions.

The connection between the switches and the electric valve occurs essentially at the mains voltage (220 V and 110 V) and therefore with considerable danger for the user.

In order to minimize this danger, the switches must be appropriately insulated. This requires a considerable expenditure of materials as well as a considerable increase in constructive complexity and production times.

Therefore, this first constructional type, in addition to not ensuring perfect safety of the controls available to the user, also entails high production costs.

A second constructional type, aimed at obviating the drawbacks pointed out as regards the first constructional type, again has switches which are accommodated in the handle of the fixture, said switches being in this case connected at a low voltage (12–18 V) to an electronic board or, simply, to a transformer, which are accommodated inside the body of the appliance.

Although this second solution drastically reduces the risks due to the passage of current proximate to the regions held by the user, it does not solve the problem of costs.

While on one hand the user is better protected (but can still run the risk of receiving low-voltage shocks, which are not dangerous but are nonetheless very unpleasant), on the other hand the need to use an electronic board or a transformer entails an even greater cost increase than the above-mentioned switch protections.

A third recent type entails accommodating, inside the handle, a wheel that actuates a cable which slides within a sheath that is in turn accommodated inside the steam connection tube.

Said cable leads into the body of the steam-generating appliance, inside which it actuates the opening or closure of an electric valve.

Although this third constructional type obviates the safety problem due to the circulation of electric current proximate to the handle, it has characteristics of low reliability during prolonged and intense use and has proved to be awkward for the user.

SUMMARY OF THE INVENTION

A principal aim of the present invention is to provide a control device, particularly for steam-generating appliances used in the field of cleaning, that solves the drawbacks pointed out above of known types, particularly obviating completely the problem of user safety but at the same time ensuring considerable reliability in use, even if subjected to heavy and prolonged work loads.

Accordingly, an object of the present invention is to provide a control device that is constructively simple and can be adapted to the various steam-generating appliances currently manufactured for specific uses.

Another object of the present invention is to provide a control device that can be actuated easily and ergonomically by the user.

Another object of the present invention is to provide a control device the production times and costs whereof are competitive with respect to known devices.

Another object of the present invention is to provide a control device that can be manufactured with conventional technologies.

With this aim, these and other objects in view, there is provided a control device, particularly for steam-generating appliances used in the field of household and/or industrial cleaning, characterized in that it comprises at least one component having a variable internal volume that is accommodated in the handle of the fixture of the steam-generating appliance, said component being filled with a nonconducting fluid and being compressible, said at least one component having a variable internal volume being connected, by means of an actuation tube, to a pressure transducer that is accommodated inside the body of said steam-generating appliance and is in turn coupled to a steam delivery control means.

BRIEF DESCRIPTION OF THE DRAWINGS

Further characteristics and advantages of the present invention will become apparent from the following detailed description of four embodiments thereof, illustrated only by way of non-limitative example in the accompanying drawings, wherein.

DESCRIPTION OF THE PREFERRED EMBODIMENTS

Figure 1:
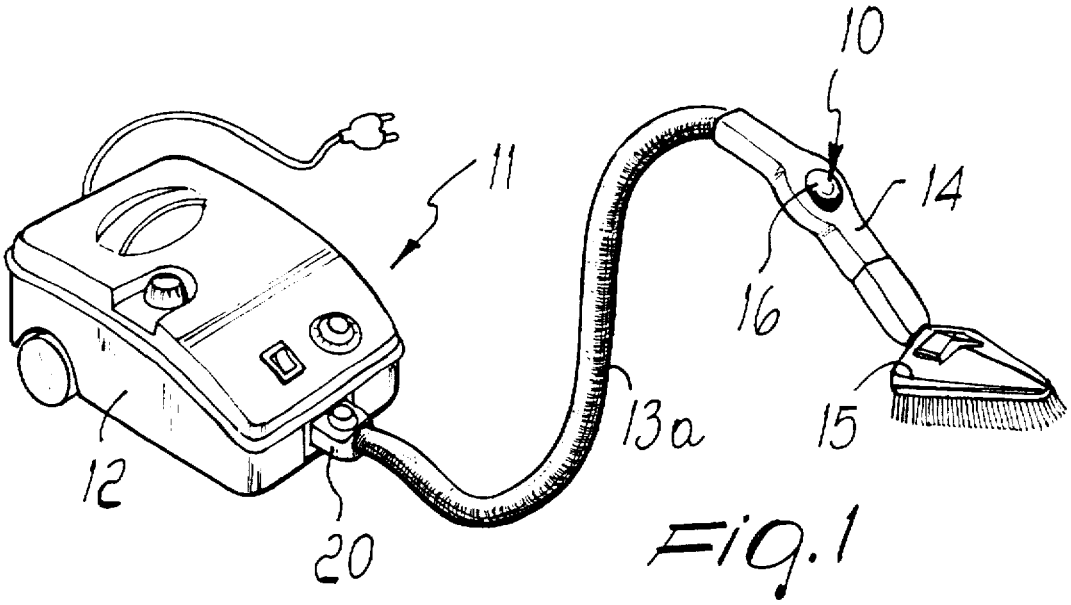
FIG. 1 is a perspective view of a control device according to the invention in a first embodiment thereof, shown accommodated in a steam-generating appliance.
Figure 2:
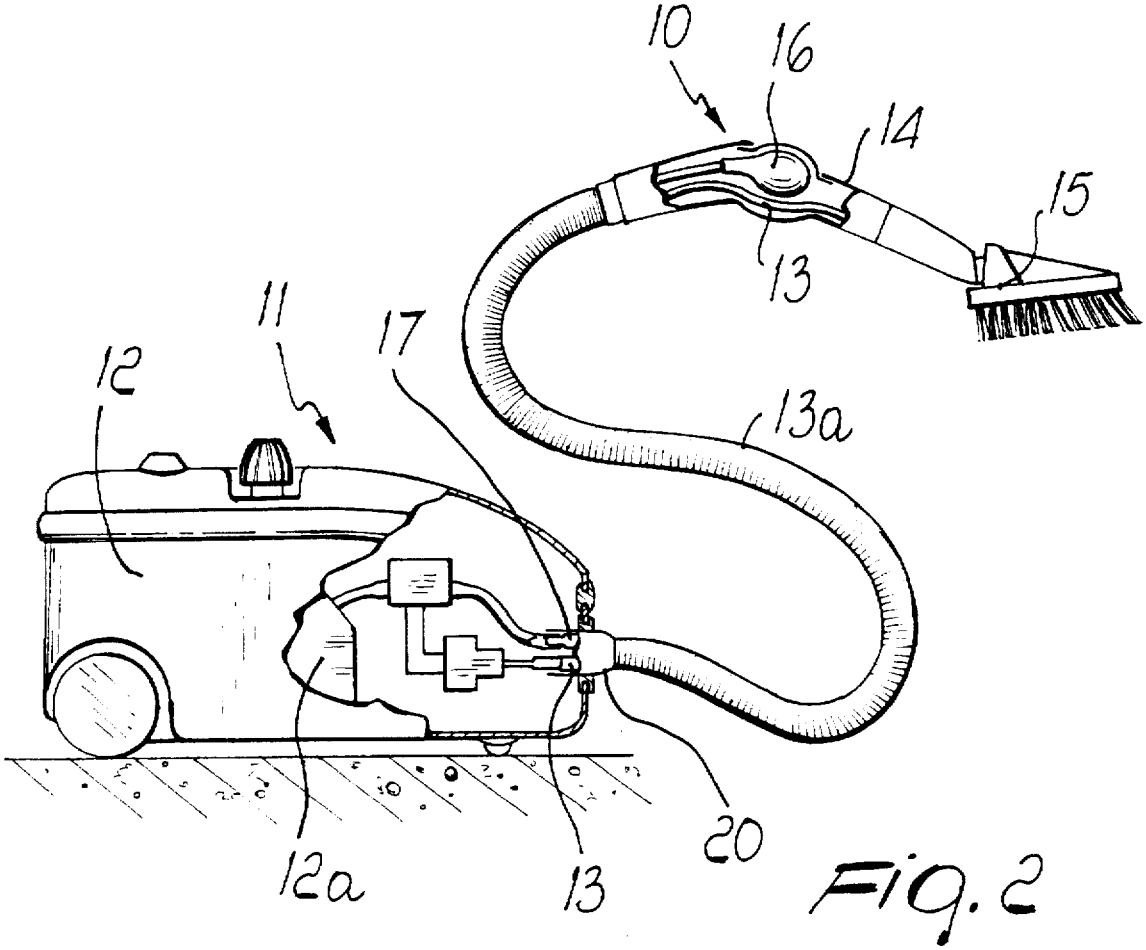
FIG. 2 is a partially sectional elevational side view of the control device of FIG. 1, again shown accommodated inside a steam-generating applicance.
Figure 3:
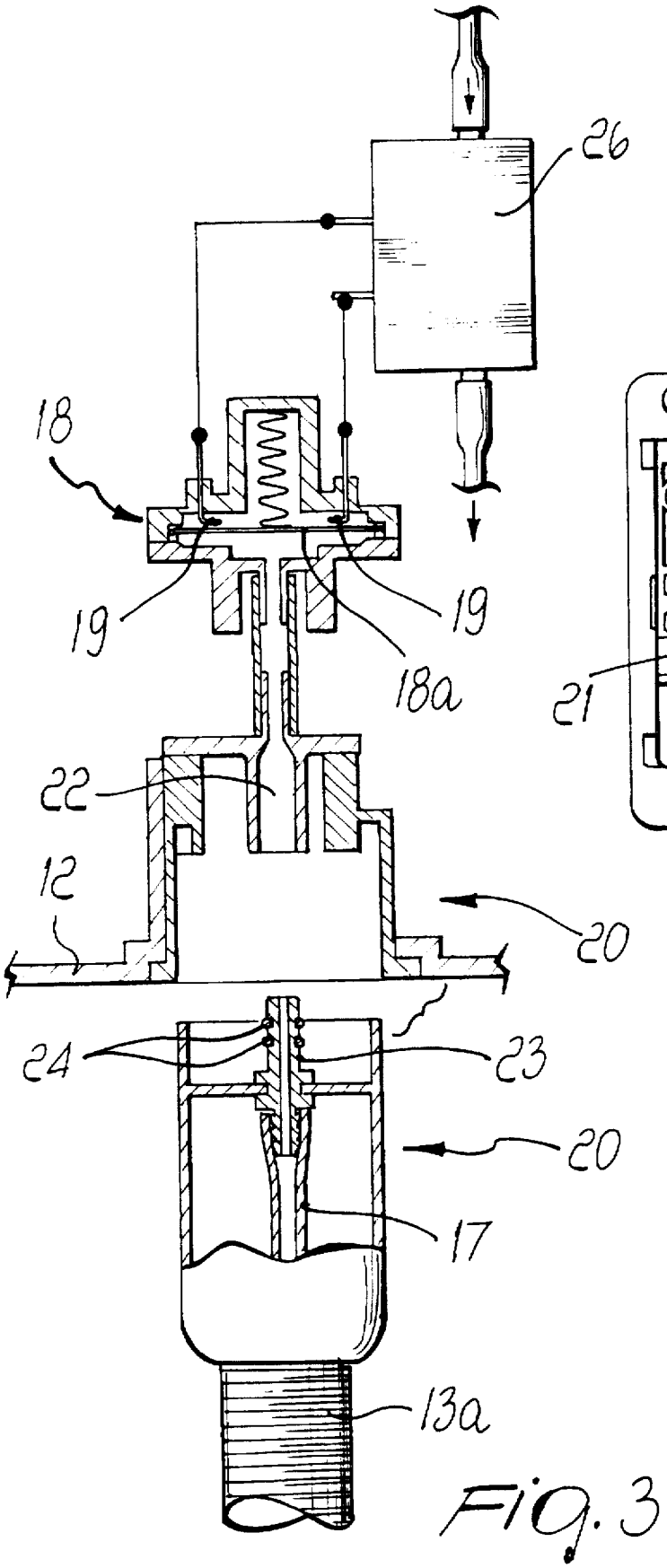
FIG. 3 is a partially sectional elevational view of a detail of the control device of FIG. 1.
Figure 4:
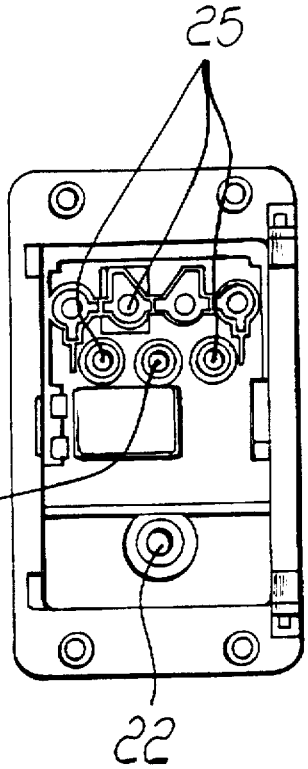
FIG. 4 is a front view of another detail of the control device of FIG. 1.

With particular reference to FIGS. 1 to 4, a control device, particularly for steam-generating appliances used in the field of household and/or industrial cleaning, according to the invention, is generally designated by the reference numeral 10 in a first embodiment.

The control device 10, in this case, is part of a steam-generating appliance, generally designated by the reference numeral 11, which is provided with a body 12 that accommodates a boiler 12*a* or another steam generator, to which a flexible tube 13 for the passage of steam is connected, in this case in a detachable manner; a handle 14 is also detachably fixed to the free end of said tube, and steam distribution fixtures, generally designated by the reference numeral 15 in the figures, can be connected to said handle.

The control device 10 comprises a component having a variable internal volume, which in this case is constituted by a bulb 16 made of a flexible material (for example rubber) and accommodated in the handle 14.

Part of the surface of the bulb 16 protrudes outside the handle 14 so as to be available for direct compression on the part of the user.

The bulb 16 is furthermore filled, in this case, with air or another compressible and nonconducting fluid, and is hermetically connected, through an actuation tube 17 lying inside a flexible tube 13*a* (inside which the tube 13 is also arranged), to a pressure transducer, which in this case is constituted by a per se known and commercially available pressure switch 18, of the normally-open membrane type that is accommodated in the body 12.

More specifically, said membrane 18*a* is provided with an electric bridge that is normally adjacent to, but not in contact with, electrical contacts 19; when subjected to a pressure pulse caused by the compression of the bulb 16, said membrane closes the circuit between said electrical contacts 19 and thus acts as a switch.

In this first embodiment, the tube 13 and the tube 17 are connected to the body 12 in a detachable manner by means of a coupling 20 that is in turn associated with the pressure switch 18, but in other cases the connection can be fixed.

In this case, the coupling 20 comprises, in addition to an opening 21 adapted for connection to the passage tube 13, a female receptacle 22 for fluid connection, inside which a male part 23 fits in the operating configuration; said male part is arranged at the end of the actuation tube 17 that is opposite to the end to which the bulb 16 is connected, and is provided with sealing rings 24.

The coupling 20, in this case, also comprises electrical terminals 25 for grounding the appliance 11 and/or for supplying electrical resistors which are not shown in the figures (if the fixture is constituted for example by an iron), or for other controls.

The pressure switch 18 actuates an electric valve 26 of a per se known type that in turn actuates the delivery of steam into the passage tube 13.

Figure 5:
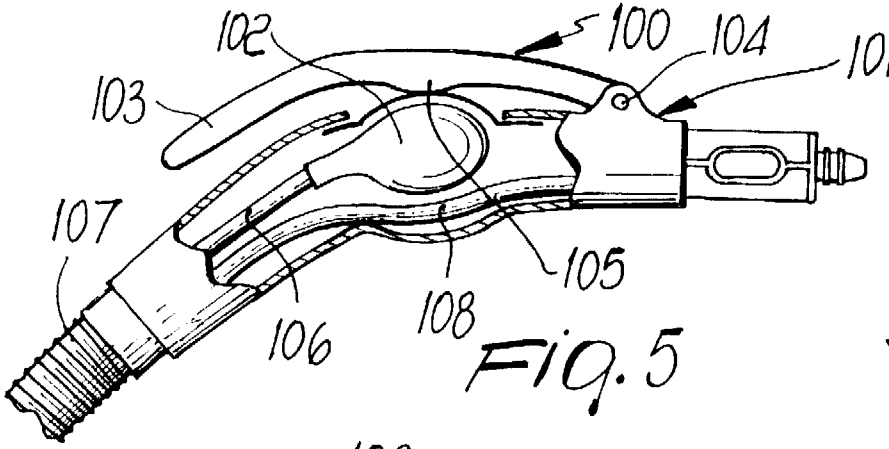
FIG. 5 is a partially sectional elevational view of a control device in a second embodiment.

With particular reference to FIG. 5, a control device according to the invention, in a second embodiment, is generally designated by the reference numeral 100.

The control device 100 is part of a handle 101 of a steam-generating appliance that is not shown in the figure but is fully similar to the appliance 11 related to the first embodiment.

The control device 100 comprises, in this case, a bulb 102 that is accommodated in the handle 101 and is made of a flexible material that can be subjected to compression performed by the user, provided indirectly by compression means described hereinafter.

The compression means, in this case, are constituted by an interposed contrasting lever 103, an end 104 whereof is pivoted to the handle 101; said lever has, in a substantially median region, a raised portion 105 that compresses the bulb 102.

The bulb 102 is furthermore connected to a pressure transducer, that is not shown in the figures, by means of an actuation tube 106 arranged inside a flexible tube 107, wherein a steam passage tube 108 is also arranged.

As regards said transducer and the optional actuation means driven thereby, reference is made to what has already been described in greater detail as regards the first embodiment.

It is also specified that instead of the lever 103 it is conveniently possible to use a pushbutton provided with elastic return means.

Figure 5A:
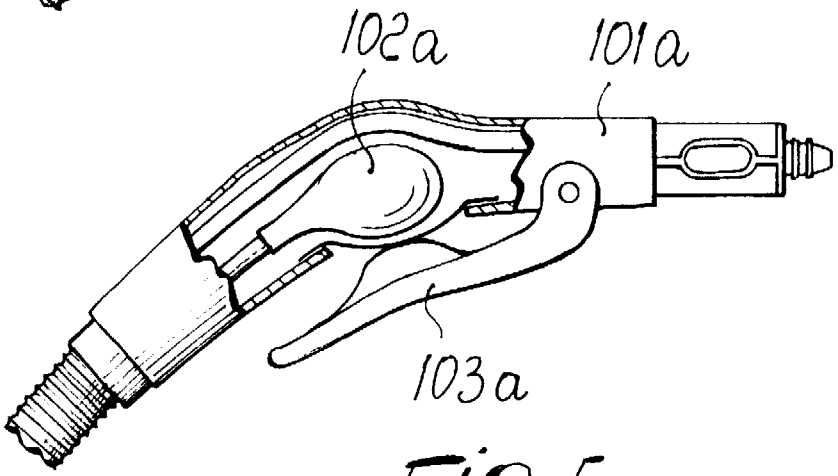
FIG. 5*a* is a view of a different embodiment of the control device of FIG. 5.

With reference to FIG. 5*a*, in a different embodiment, the lever, now designated by the reference numeral 103*a*, is arranged on the corresponding handle 101*a* on the side that is diametrically opposite with respect to the preceding lever.

In the same manner, however, it acts by compression on the bulb, now designated by the reference numeral 102*a*.

Figure 6:
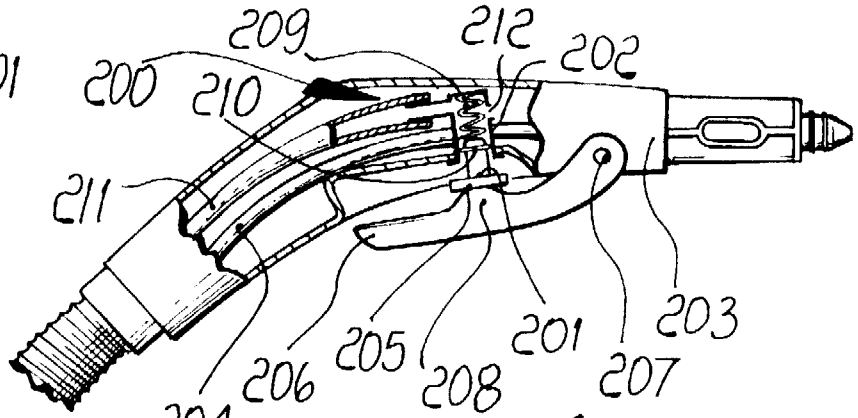
FIG. 6 is a partially sectional elevational view of a control device according to the invention, in a third embodiment.

With particular reference to FIG. 6, a control device according to the invention, in a third embodiment, is generally designated by the reference numeral 200.

The control device 200 comprises a component having a variable internal volume, which in this case is constituted by a piston 201 that can be movably accommodated in a seat 202 formed in a handle 203 that is connected by means of a steam passage tube 204 to a body, not shown in the figure, of an appliance of the type described with reference to the first embodiment.

In this third embodiment, the variable volume is determined in association by the piston 201 and by the seat 202.

Furthermore, in this case the piston 201 makes its head 205 available to the user by virtue of compression means, which in this case are constituted by a lever 206 of the interposed contrasting type, having an end 207 that is pivoted to the handle 203 and a raised portion 208 that compresses the piston 201 (the piston 201 can also be pressed directly).

Moreover, the piston 201 is provided with elastic return means, which are constituted by a helical spring 209 that is also accommodated inside the seat 202, has an end resting on the bottom of said seat and another end resting on the internal end of said piston 201.

The piston 201 furthermore comprises fluid tightness means, constituted in this case by an elastomer ring 210 of a per se known type, and can be associated with a vent 212 that acts when it is inactive and is adapted to compensate for any unwanted increases in pressure generated by the heat of the steam tube 204 that would activate said transducer.

The component having a variable internal volume, constituted by the piston 201 and by the seat 202, is connected, by an actuation tube 211, to a transducer (which in this case is constituted by a low-pressure pressure switch of the membrane type, like the switch 18) that is not shown in the figures. The remaining components of the control device 200 are substantially identical to those which have been set forth in greater detail with reference to the first embodiment.

Figure 7:
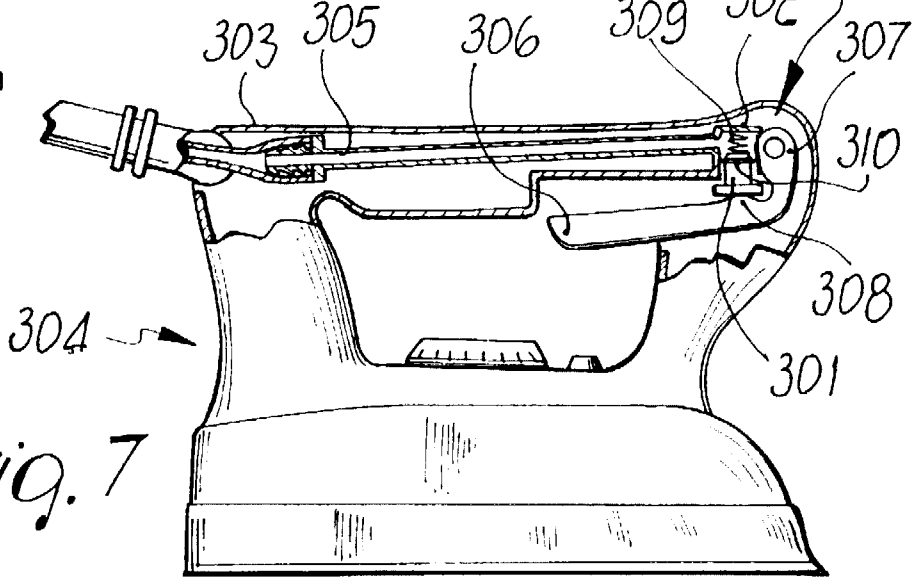
FIG. 7 is a partially sectional elevational view of a control device according to the invention, in a fourth embodiment.

With particular reference to FIG. 7, a control device according to the invention, in a fourth embodiment, is generally designated by the reference numeral 300.

The control device 300 is fully similar to the control device 200, since it comprises a piston 301 that is movably accommodated inside a seat 302, which in this case is formed in the handle 303 of an iron that is generally designated by the reference numeral 304.

The piston 301 and the seat 302 form, as in the previous embodiment, the component having a variable internal volume, which is connected, by means of an actuation tube 305, to a transducer and to other actuation components, for the description whereof reference is made to the first embodiment.

In this fourth embodiment, the piston 201 is available for compression on the part of the user by means of a lever 306 of the interposed contrasting type, which has an end 307 pivoted to the handle 303 and a raised portion 308 that performs the actual compression of the piston 301.

Furthermore, the seat 202 internally accommodates a helical spring 309 adapted to act as elastic return means for the piston 301, which also comprises a per se known elastomer gasket 310.

In practice, it has been observed that the intended aim and objects have been achieved; in particular, it should be noted that the device according to the invention fully solves the problem of user safety while ensuring easy use and structural strength.

Furthermore, the constructive simplicity of the invention and its structural adaptability to steam-generating appliances used for different services make it economically and constructively competitive with respect to known devices.

The considerable ergonomy achieved by the invention even in its simpler embodiments should also be noted; this ergonomy can be increased substantially at will in more expensive and sophisticated models by simply applying means for indirectly applying the pressure applied by the user.

The present invention is susceptible of numerous modifications and variations, all of which are within the scope of the inventive concept.

All the details may furthermore be replaced with other technically equivalent elements.

The materials and the dimensions may be any according to the requirements.

What is claimed is:

1. Control device, particularly for steam-generating appliances used in the field of household and/or industrial cleaning, comprising at least one component having a variable internal volume that is accommodated in the handle of the fixture of the steam-generating appliance, said component being filled with an electrically nonconducting fluid, said at least one component having a variable internal volume being connected, by means of an actuation tube, to a pressure transducer that is accommodated inside the body of said steam-generating appliance and is coupled to a steam delivery control means, wherein said pressure transducer comprises a pressure switch that converts a fluidic pressure variation signal into an electrical signal, and wherein said pressure switch comprises a membrane provided with an electric bridge that is normally adjacent to, but not in contact with, electrical contacts, said membrane, subjected to a low-pressure pulse, being arranged for closing a circuit between said electrical contacts.

2. Control device according to claim 1 wherein said electrically nonconducting fluid is a compressible fluid.

3. Control device according to claim 1 wherein said component having a variable internal volume comprises a bulb made of a flexible material.

4. Control device according to claim 1 wherein said component having a variable internal volume comprises a piston movably accommodated in a seat formed in said handle and forming, in association with said seat, the variable volume of said component, the device further comprising elastic return means for said piston and steam venting means that act when the piston is inactive.

5. Control device according to claim 4, further comprising means for compressing said component having a variable internal volume, said means being constituted by a push-button.

6. Control device according to claim 4, wherein said elastic return means comprise a helical spring, in which one end rests on the bottom of said seat and the other end is in contact with the internal end of said piston.

7. Control device according to claim 4, further comprising means for compressing said component having a variable internal volume, said means being constituted by a lever device.

8. Control device, particularly for steam-generating appliances used in the field of household and/or industrial cleaning, comprising at least one component having a variable internal volume that is accommodated in the handle of the fixture of the steam-generating appliance, said component being filled with an electrically nonconducting fluid, said at least one component having a variable internal volume being connected, by means of an actuation tube, to a pressure transducer that is accommodated inside the body of said steam-generating appliance and is coupled to a steam delivery control means, wherein said pressure transducer comprises a pressure switch that converts a fluidic pressure variation signal into an electrical signal, and wherein said pressure switch is connected to a coupling for said actuation tube and a steam passage tube, said coupling being provided with at least one female receptacle for fluidic connection, inside which, in the operating configuration, a male part fits, said male part being fixed at the end of said actuation tube that is opposite to the end whereon said component having a variable internal volume is connected.

9. Control device according to claim 8, wherein said coupling comprises an electrical terminal for one of: the grounding of said appliance; and the supply of electric resistors that are present in said appliance.

10. Control device according to claim 1, wherein said control means comprise an electric valve that dispenses steam.

11. A control device in a steam-generating appliance having a main body accommodating a steam-generating device, an outer tube extending from said main body, a fixture handle connected to said outer tube distally from said main body, and a steam passage tube arranged inside said outer tube and extending between said steam-generating device to said fixture handle, the control device comprising at least one component having a variable internal volume that is accommodated in the fixture handle, said component being filled with an electrically nonconducting fluid, said at least one component having a variable internal volume being connected, by means of an actuation tube arranged inside said outer tube, to a pressure transducer that is accommodated inside the body of said steam-generating appliance and is coupled to a steam delivery control means, the control device further comprising a steam vent to compensate for pressure increases due to heat produced in said steam passage tube so that said pressure transducer is not activated by said pressure increases.

* * * * *